US005408574A

United States Patent [19]

Deevi et al.

[11] Patent Number: 5,408,574

[45] Date of Patent: Apr. 18, 1995

[54] FLAT CERAMIC HEATER HAVING DISCRETE HEATING ZONES

[75] Inventors: Seetharama C. Deevi, Midlothian; Mohammad R. Hajaligol, Richmond, both of Va.

[73] Assignee: Philip Morris Incorporated, New York, N.Y.

[21] Appl. No.: 35,682

[22] Filed: Mar. 23, 1993

Related U.S. Application Data

[63] Continuation-in-part of Ser. No. 803,174, Dec. 5, 1991, Pat. No. 5,224,498, which is a continuation of Ser. No. 444,569, Dec. 1, 1989, Pat. No. 5,093,894.

[51] Int. Cl.[6] ..... H05B 3/26

[52] U.S. Cl. ..... 392/404; 128/202.21; 128/203.27; 131/273; 219/543

[58] Field of Search ..... 131/273, 274, 329; 128/202.21, 203.17, 203.27; 219/543, 530, 540, 548; 392/404, 390, 395

[56] References Cited

U.S. PATENT DOCUMENTS

| | | | |
|---|---|---|---|
| 3,496,336 | 2/1970 | Hingorany et al. | 219/464 |
| 3,978,315 | 8/1976 | Martin et al. | 219/543 |
| 4,203,025 | 5/1980 | Nakatani et al. | 219/216 |
| 4,259,564 | 3/1981 | Ohkubo et al. | 219/216 |
| 4,261,764 | 4/1981 | Narayan | 148/1.5 |
| 4,298,786 | 11/1981 | Marciniec | 219/216 |
| 4,517,449 | 5/1985 | Chazan et al. | 219/549 |
| 4,548,662 | 10/1985 | Chazan et al. | 156/86 |
| 4,659,912 | 4/1987 | Derbyshire | 219/535 |
| 4,701,427 | 10/1987 | Boecker et al. | 501/92 |
| 4,707,909 | 11/1987 | Blanchard | 437/109 |
| 4,766,409 | 8/1988 | Mandai | 338/22 |
| 4,772,488 | 9/1988 | Pinch et al. | 427/39 |
| 4,777,022 | 10/1988 | Boldish et al. | 422/245 |
| 4,777,060 | 10/1988 | Mayr et al. | 427/34 |
| 4,778,649 | 10/1988 | Niino et al. | 419/9 |
| 4,780,248 | 10/1988 | Donohue et al. | 252/518 |
| 4,788,045 | 11/1988 | Colombet et al. | 423/85 |
| 4,789,653 | 12/1988 | Ogata et al. | 501/134 |
| 4,791,078 | 12/1988 | Saito et al. | 501/136 |
| 4,799,983 | 1/1989 | Desai | 156/89 |
| 4,799,983 | 1/1989 | Desai | 156/89 |
| 4,814,586 | 3/1989 | Grise | 219/549 |
| 4,819,128 | 4/1989 | Florian et al. | 361/321 |
| 4,822,983 | 4/1989 | Bremner et al. | 219/505 |
| 4,830,876 | 5/1989 | Dietrich et al. | 427/96 |
| 4,845,839 | 7/1989 | Brown | 29/620 |
| 4,849,251 | 7/1989 | Tanaka | 427/101 |
| 4,883,947 | 11/1989 | Murase et al. | 219/553 |
| 4,885,661 | 12/1989 | Yokotani et al. | 361/321 |
| 4,889,961 | 12/1989 | Carlson | 29/846 |
| 4,889,974 | 12/1989 | Auding et al. | 219/543 |
| 4,895,771 | 1/1990 | Souter et al. | 428/670 |
| 4,899,126 | 2/1990 | Yamada | 338/309 |
| 4,908,599 | 3/1990 | Breen et al. | 338/22 |
| 4,914,417 | 4/1990 | Matsui et al. | 338/174 |
| 4,919,744 | 4/1990 | Newman | 156/308.2 |
| 4,930,045 | 5/1990 | Carlson et al. | 361/329 |
| 4,985,176 | 1/1991 | Watanabe et al. | 252/521 |
| 4,987,108 | 1/1991 | Takagi et al. | 501/138 |
| 5,060,671 | 10/1991 | Counts et al. | 131/329 |
| 5,093,894 | 3/1992 | Deevi et al. | 392/390 |
| 5,095,921 | 3/1992 | Losee et al. | 131/194 |
| 5,274,214 | 12/1993 | Blackburn . | |
| 5,274,352 | 12/1993 | Mishikawa et al. | 338/308 |

FOREIGN PATENT DOCUMENTS

| | | | |
|---|---|---|---|
| 0160761 | 11/1985 | European Pat. Off. . | |
| 0438862 | 7/1991 | European Pat. Off. . | |
| 3016604 | 11/1981 | Germany | 219/543 |
| 3-208284 | 9/1991 | Japan | 219/543 |
| 2148079 | 5/1985 | United Kingdom . | |
| 2148676 | 5/1985 | United Kingdom . | |
| 2168381 | 6/1986 | United Kingdom . | |

*Primary Examiner*—Geoffrey S. Evans
*Attorney, Agent, or Firm*—Charles E. B. Glenn; James E. Schardt; Kevin B. Osborne

[57] ABSTRACT

A plurality of resistive heating elements and conductive elements are screenprinted onto a ceramic substrate to form a heater having multiple resistive heating elements. Slots formed between adjacent resistive heating elements members provide air gaps to thermally insulate each heating element from neighboring elements. Gold-plated leads provide low contact resistance for receiving power from a battery for energizing each of the resistive heating elements.

16 Claims, 18 Drawing Sheets

FLAT CERAMIC HEATER HAVING DISCRETE HEATING ZONES

This application is a continuation-in-part of U.S. patent application Ser. No. 803,174, filed Dec. 5, 1991, now U.S. Pat. No. 5,224,498, which itself is a continuation of application Ser. No. 444,569, filed Dec. 1, 1989, now U.S. Pat. No. 5,093,894.

BACKGROUND OF THE INVENTION

The present invention relates to resistive heaters, and particularly to heaters for use in smoking articles in which a tobacco flavor-generating medium is heated to release tobacco flavors.

Previously known smoking articles deliver flavor and aroma to the smoker as a result of tobacco combustion. During combustion, which typically occurs at temperatures in excess of 800° C., various distillation and pyrolysis products are produced. As these products are drawn through the body of the smoking article toward the mouth of the smoker, they cool and condense to form an aerosol or vapor which provides the flavor and aroma associated with smoking.

Such conventional smoking articles have various perceived drawbacks associated with them, such as the production of sidestream smoke. Additionally, the combustion process cannot be easily suspended by the smoker in order to allow storage of the smoking article for later consumption. Although a conventional smoking article, such as a cigarette, may be extinguished prior to its being smoked to completion, it is typically not convenient or practical to save the cigarette for later use.

Alternative smoking articles are known where a flavor-generating medium of tobacco or a tobacco-derivative may be heated, without combustion, thereby releasing tobacco flavors without producing smoke. Smoking articles that provide a flavor aerosol without tobacco combustion are described in commonly assigned U.S. Pat. No. 5,146,934, and commonly assigned U.S. patent applications Ser. No. 07/443,636, filed Nov. 29, 1989 (Case PM-1389), and Ser. No. 07/732,619, filed Jul. 19, 1991 (PM-1353). Smoking articles may also use electrically-powered heaters to heat the tobacco flavor-generating medium. This generally requires that the tobacco medium be heated to a temperature of at least 300° C., preferably within a period of 2.0 seconds and more desirably to a temperature above 500° C. in less than 1 second.

Resistive heating elements for electric heaters may be constructed from ceramics. However, conventional ceramic heaters typically require a period of minutes to heat up. Further, a smoker of an electrically-powered smoking article should be able to either energize or shut off the article on demand. For use in electrically-powered smoking article, a resistive heater should also be small, and operate on low voltage batteries.

It would therefore be desirable to be able to provide a resistive heater for use in an electrically-powered smoking article.

It would also be desirable to be able to provide a low-voltage battery-powered ceramic heater that produces temperatures sufficiently high to release tobacco flavors from tobacco on a tobacco derivative.

It would further be desirable to be able to provide a ceramic heater that has a plurality of discrete resistive heating elements that may be individually energized.

It would still further be desirable to be able to provide a heater having ceramic heating elements that may be energized rapidly.

It would yet further be desirable to be able to provide a process for fabricating such a heater.

SUMMARY OF THE INVENTION

It is therefore an object of the invention to provide a resistive heater for use in an electrically-powered smoking article.

It is also an object of this invention to provide a low-voltage battery-powered ceramic heater that produces temperatures sufficiently high to release tobacco flavors from tobacco or a tobacco derivative.

It is a further object of this invention to provide a ceramic heater that has a plurality of discrete resistive heating elements that may be individually energized.

It is a still further object of this invention to provide a heater having ceramic heating elements that may be energized rapidly.

It is a yet further object of this invention to provide a process for fabricating such a heater.

This invention provides a resistive heater for use in an electrically-powered smoking article. Such a smoking article is preferably provided with a heater having a plurality of resistive heating elements that may be individually energized by a low-voltage battery. Tobacco or a tobacco derivative is placed in contact with the heating elements so that when they are energized a flavored aerosol or vapor is produced that may be inhaled by a smoker. The tobacco flavor-generating medium may be sprayed onto the heating elements and subsequently dried before use. After the tobacco flavor-generating medium in contact with the heating elements has been consumed, a new set of heating elements is used.

The electrically-powered smoking article is intended to be held by a smoker in the lips and therefore is relatively lightweight, compact and portable. Further, when desired by a smoker, one of the heating elements may be selectively energized thus delivering a predetermined quantity of tobacco flavored vapor. The smoking article may be configured so that power is switched between individual heating elements directly by the smoker or triggered by control circuitry. An advantage of electrically-powered smoking articles is that they may be stored after being partially consumed. At a later time, smoking may be resumed. Further, such non-burning smoking articles give the smoker the sensation and flavor of smoking without actually creating some of the smoke components associated with combustion. This may allow the smokers of non-burning articles to enjoy their use in areas where conventional smoking is discouraged.

In accordance with this invention, a plurality of resistive heating elements are formed on a flat ceramic substrate. Conductive leads, which receive power from a battery, are used to interconnect the resistive elements. The resistive heating elements that are provided in accordance with the invention are sufficiently lightweight and compact that they may be placed within the body of a smoking article that is no larger than a conventional cigarette. The resistance of each element is low enough that it may be driven by a readily available low voltage battery while still providing a temperature sufficiently high to produce a flavored aerosol from a tobacco flavor-generating medium. Further, the heaters of the present invention are amenable to batch processing and may therefore be produced inexpensively.

In accordance with the invention a printed heater is provided that has a ceramic substrate and at least one resistive heating element disposed on the substrate. A plurality of conductive elements are used to interconnect the resistive heating elements with a power supply so that when sufficient current flows through a resistive heating element a temperature rise is produced in the resistive heating element in the range of 300° C. to 900° C.

BRIEF DESCRIPTION OF THE DRAWINGS

The above and other objects and advantages of this invention will be apparent on consideration of the following detailed description, taken in conjunction with the accompanying drawings, in which like reference characters refer to like parts throughout and in which.

DETAILED DESCRIPTION OF THE INVENTION

Figure 1:
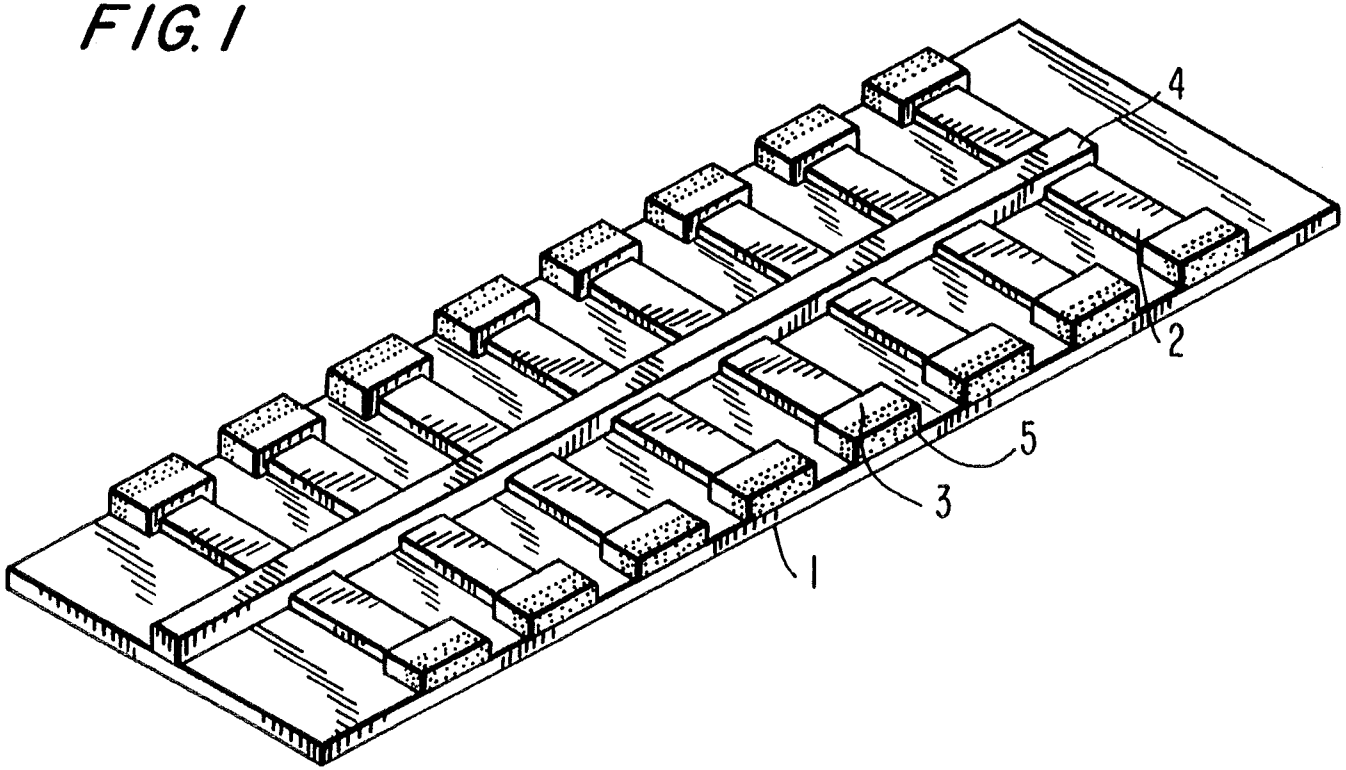
FIG. 1 is a perspective view of an illustrative embodiment of a resistive heater constructed in accordance with the invention.

Referring to FIGS. 1–14, which show illustrative embodiments of the heater in accordance with the present invention, the heater has ceramic substrate 1 and resistive heating elements 2. In this embodiment, substrate 1 provides physical support for resistive heating elements 2. The ceramic substrate 1, while being rigid enough to physically support the resistive heating elements 2, can also be made flexible enough to facilitate easy handling and resist fracture during the manufacturing process. Ceramic substrate 1 is thermally stable at elevated temperatures and will not deform or become chemically reactive at the temperatures that are encountered when resistive heating element 2 is active.

Each of the heating segments may be switchably connected to a power source in a manner which would allow current from the power source to be directed through a given resistive heating element 2 to heat it. This switching of power to a particular segment could be directly controlled by the smoker or triggered by control circuitry. The interconnections between resistive elements 2 and an electrical power source and the control circuitry may be made by conventional wires attached to each of the segments or by using wiring embedded in socket 6. In either case, contact is made to conductor bus bar 4 and contacts 3. If it is desired to reduce the contact resistance between contacts 3 and the wires or the conductive elements of socket 6, metal coating 5, which is a thin film (~200 Å) of a relatively inert metal such as gold, may be deposited onto the surface of contacts 12 by, for instance, sputter coating, evaporation, electroplating or other conventional techniques. The resistivity of an individual resistive heating element 2 must be such that when current flows through the segment a temperature sufficient to induce the tobacco flavor-generating medium to produce an aerosol or vapor is achieved. Typically this temperature is between about 100° C. and 600° C., preferably between 250°–500° C. and most preferably between about 350°–450° C. The resistivity cannot be so high as to be incompatible with available batteries, nor can it be so low that the power consumption requirement of the segment exceeds the capacity of the source. Typically, resistive heating elements 2 having resistances between 0.2 and 5.0 Ω preferably between 0.5 and 1.5 Ω and most preferably between 0.8 and 1.2 Ω, can achieve such operating temperatures when connected across a potential of between 2.4 and 9.6 volts.

Throughout their range of operating temperatures, resistive heating elements 2 must be chemically nonreactive with the tobacco flavor-generating medium being heated, so as not to adversely affect the flavor or content of the aerosol or vapor produced by the tobacco flavor-generating medium.

In a smoking article in which a flavor dot of tobacco or tobacco-derived material is heated without combustion of the tobacco or tobacco-derived material to release tobacco flavors, the flavor dot must be heated to a temperature of at least 300° C. and more preferably in the range of 500°–600° C. A heater for such a smoking article should be able to reach a peak temperature, within 0.5 to 2.0 seconds, and more preferably within 1 second. Because a smoker expects multiple releases of tobacco flavor each heater includes a plurality of resistive heating elements 2, only one of which is energized at a time. The size and power requirements of the heater are dictated by the size of the smoking article, because the heater and its power source must fit within the smoking article.

In general, each resistive heating element 2 should provide a uniform temperature distribution across its surface with only minimal thermal gradients. Similarly, each resistive heating element 2 should provide a uniform voltage drop and current flow between its power contacts. Each resistive heating element 2 should be thermally isolated by substrate 1 from other resistive heating elements 2. The heater should be designed to minimize heat loss to substrate 1, which acts as a thermal sink, by employing a high electrical resistance, low thermal conductivity material for substrate 1. Contacts 3 at which power is supplied to the heater should have significantly lower resistances than the heating elements, so that contacts 3 do not heat needlessly.

Substrate 1 acts as a base member to hold a plurality of resistive heating elements 2, conductive interconnections, and the contact terminals through which power is supplied to each of heating elements 2. Substrate 1 should be strong, thermally stable, and electrically insulating. A ceramic substrate material provides strength as well as excellent thermal and electrical insulation for the discrete resistive heating elements 2. Typical examples of suitable ceramic substrates are alumina, zirconia (partially or fully stabilized either with yttria, calcia or magnesia), magnesia, yttria, corderite, mullite, forsterite, or steatite.

Ceramics have advantage over other substrate materials such as metals and polymers. For instance, metallic substrates generally must be both thermally and electrically insulated from the heating zones, because the high thermal conductivity of metals absorbs the heat generated by a heating element too rapidly during energization. Most metallic substrates also require electrical insulation because of their electrical conductivity. In contrast, most polymeric films are dielectrics requiring little electrical insulation. However, polymeric films require thermal insulation because they lack thermal stability above approximately 350° C.

Ceramic substrates are available in the form of fired ceramic sheets or green tape. The resistive and conductive elements can be printed directly onto a fired ceramic sheet substrate, with no additional processing steps required to strengthen the substrate. Fired ceramic sheets comprising 96% $Al_2O_3$ are available from Kyocera Corporation, at 5–22 Kitainoue-cho, Higashino, Yamashina-ku, Kyoto 67, Japan. Green tapes are available from DuPont Corporation of Wilmington, Delaware. The properties of Kyocera sheets and DuPont green tape that are 10 mils thick are shown below.

| Type | Density ($g\text{-}cm^{-3}$) | Thermal Conductivity ($W\text{-}m^{-1}K^{-1}$) | Heat Capacity ($Cal\text{-}g^{-1}K^{-1}$) |
|---|---|---|---|
| Kyocera | 3.80 | 21.0 | 0.19 |
| DuPont | 3.08 | 2.0 | 0.21 |

Green tapes may be used for the continuous manufacturing of a large number of heaters simultaneously, and are available in rolls. The substrate is preferably sintered before the resistive and conductive elements are formed. Ceramic substrates that may be sintered at low temperatures are preferred, because low temperature sintering reduces energy consumption. Acceptable substrates include specialty alumina tapes such as 851A2 tape manufactured by DuPont Corporation of Wilmington, Del., which is cast on a mylar backing. This borosilicate tape contains between 10–30% $Al_2O_3$ with the remaining portion comprising compounds of Al, B, Ca, Mg, K, Na, $SiO_2$, and Pb and requires a sintering temperature of about 850° C. In contrast, alumina tapes manufactured by Ceramtec Corporation of Salt Lake City, Utah at 90% and 96% loadings require sintering temperatures in the range of 1400° to 1700° C., typically around 1550° C.

For a pure ceramic substrate, sintering is generally carried out in an oxygen rich environment. However, if heating elements are printed on the green tape prior to sintering, an atmosphere that is overly rich in oxygen could oxidize the elements excessively. In the case of alumina, sintering can be carried out either in an oxygen rich atmosphere or in a hydrogen atmosphere. For green tape, firing is preferably carried out in a 1:2 mixture of air and nitrogen. Some oxygen is required to ensure complete combustion of carbonaceous compounds, although this is primarily of importance with respect to conductive pastes, since the incomplete burning of these compounds might result in an excessive resistivity. Excessive oxidation may also cause the resistivity of a conductive paste to become too high during sintering.

The thermal conductivity of the substrate should be tailored to match that of resistive heating elements 2 to prevent the elements from peeling off of substrate 1 during use due to a mismatch in thermal expansion coefficients. Alumina is a preferred substrate material, because its thermal conductivity and strength can be varied by adjusting the alumina loading in the green tape. The thermal conductivity of alumina in the temperature range 20° C. to 400° C. is shown below.

| Temperature, °C. | Conductivity ($W/cm^2$) 99.9% | 96% | 90% | 85% |
|---|---|---|---|---|
| 20 | 0.39 | 0.24 | 0.16 | 0.14 |
| 100 | 0.28 | 0.19 | 0.13 | 0.12 |
| 400 | 0.13 | 0.10 | 0.08 | 0.06 |

The thermal conductivities of mullite and corderite are similar to alumina whereas the thermal conductivity of zirconia is lower. In contrast, ceramic materials like $Si_3N_4$, SiC, TiC, TaC, and $TiB_2$, exhibit higher thermal conductivities than alumina.

Thermal stability of the substrate is an important consideration. The vapor pressure of the substrate material should be very low at temperatures of up to 900° C. Although the heater is designed to operate below about 600° to 700° C., momentarily higher temperatures during energization of the heater should not result in oxidation of resistive heating elements 2 (including oxidation due to dielectric breakdown). Oxidation which would increase the vapor pressure of the substrate, can be expected from carbides and nitrides of Ti, Mo, Si, and possibly zirconium.

A preferred embodiment according to the invention includes an alumina substrate having a thickness of about 1 mil (25 μm) and generally not greater than 10 mils (250 μm). Substrates thinner than 5 mils (125 μm) tend to be too fragile. A substrate thickness greater than 30 mils (750 μm) is not necessary and may occupy too much space or may not be sufficiently flexible to avoid cracking during the manufacturing process.

Figure 11:
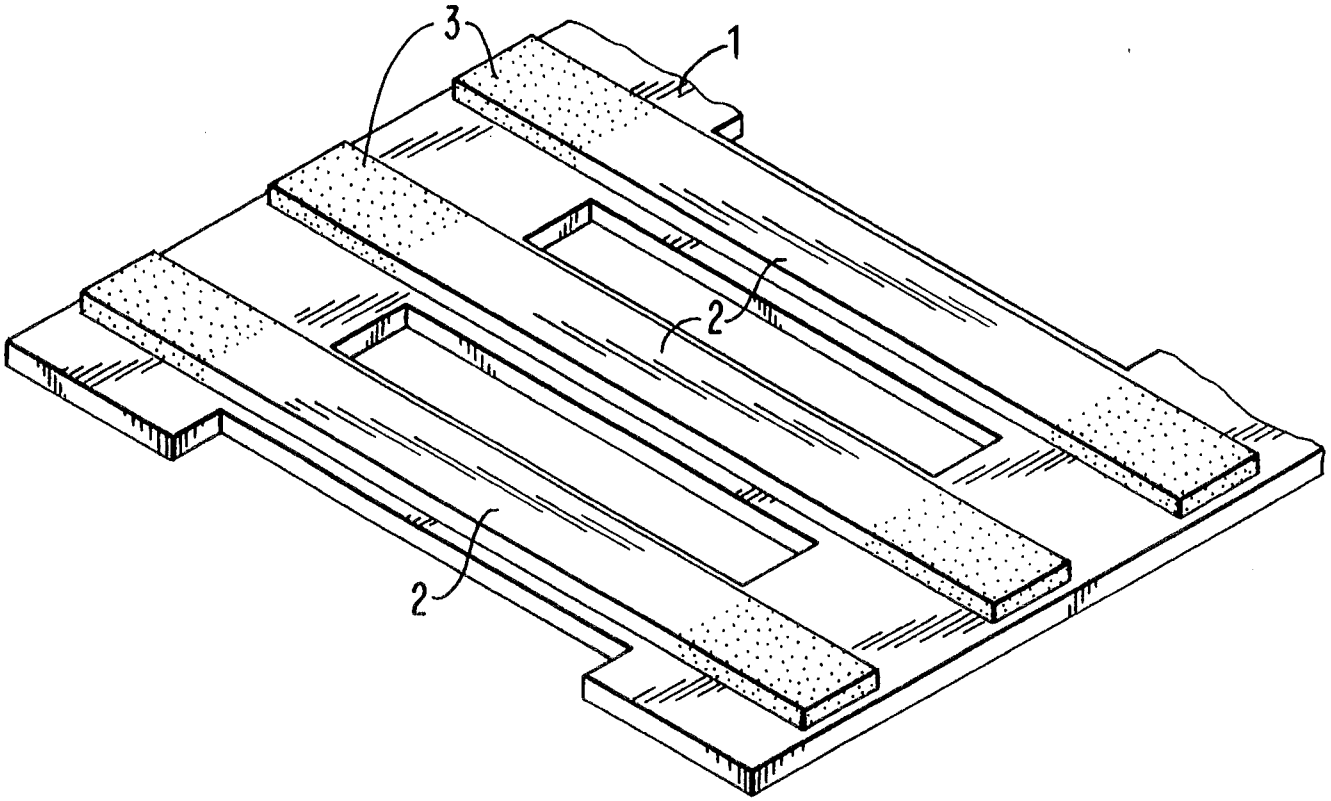
FIG. 11 is a perspective view of a further illustrative embodiment of a heater constructed in accordance with the invention where slots have been formed in the substrate between the heating elements.
Figure 12:
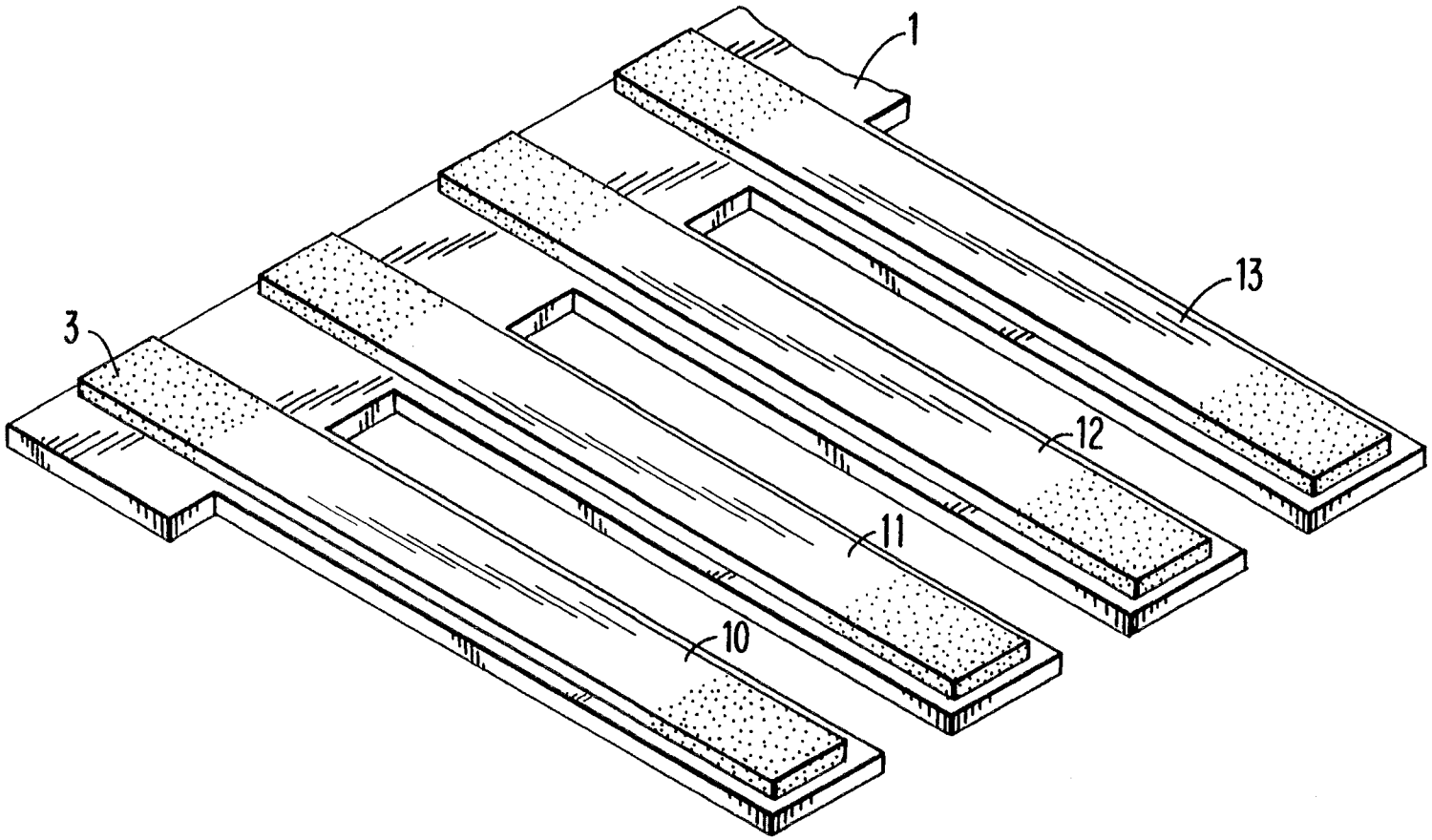
FIG. 12 is a perspective view of an illustrative embodiment of a heater constructed in accordance with the invention where the heating elements are connected by a common substrate at only one end and are separated by slots formed in the substrate.

As shown in FIGS. 11 and 12, substrate 1 may be provided with slots between adjoining heating elements 2 and heating elements 10, 11, 12, and 13 to increase thermal isolation between each of the heating elements. The presence of slots further reduces thermal conduction away from the heating elements, so that for a given applied current, the maximum temperature that is attained by an element is increased. The configuration shown in FIG. 12, in which the slots in substrate 1 extend completely through one end of substrate 1, allows the resistive heating element to which power is being applied to expand freely. Since the heating elements that are not being powered remain in an unexpanded state, stresses may develop in the absence of this feature when powering only one of the heating elements.

Figure 13:
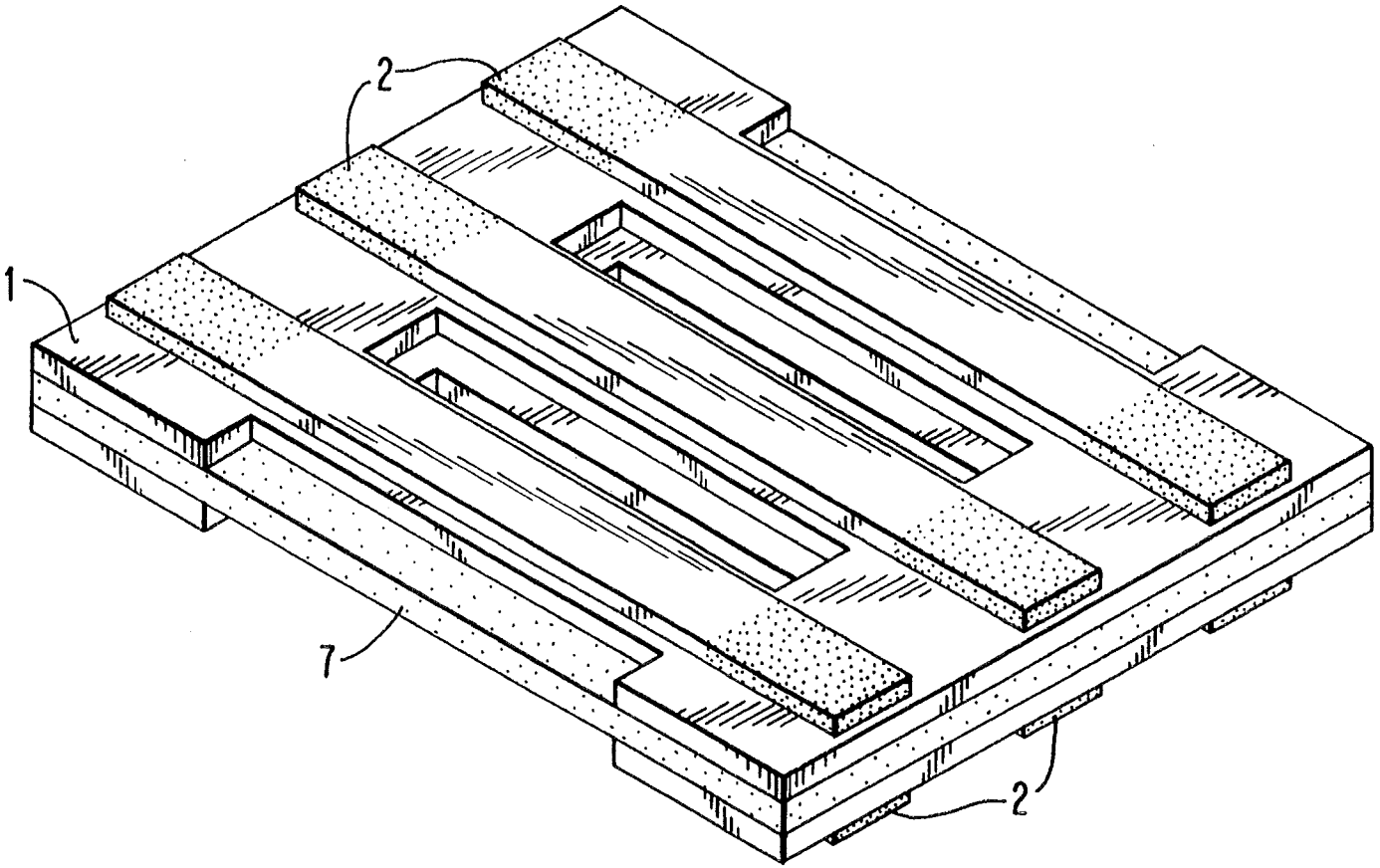
FIG. 13 is a perspective view of an illustrative embodiment of a heater, where two heaters similar to the one shown in FIG. 11 are mounted back-to-back on a spacer.
Figure 14:
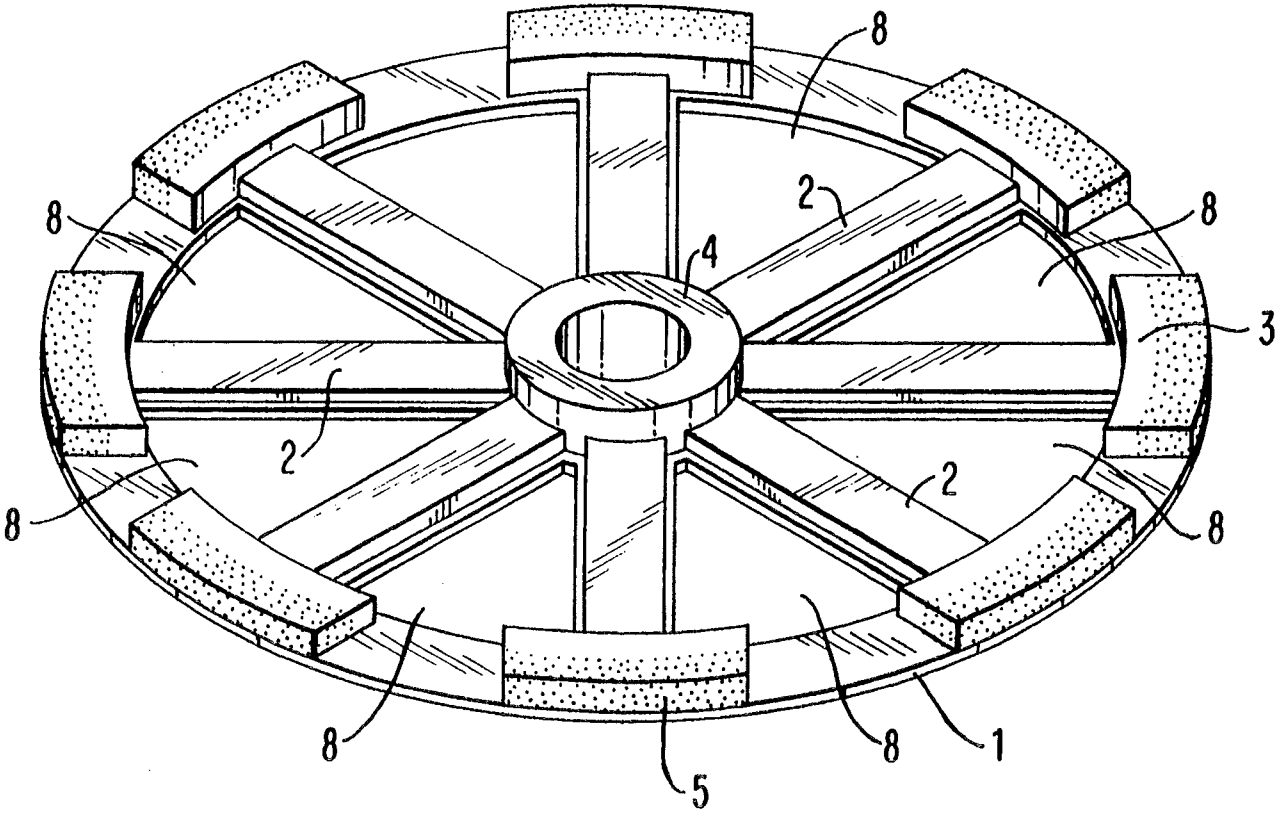
FIG. 14 is a perspective view of an illustrative heater similar to the one shown in FIG. 6 where slots have been formed in the substrate between the heating elements.

As shown in FIG. 13, it is also possible to mount two sets of heating elements back-to-back on spacer 7, which may be formed from the same material as substrate 1. As shown in FIG. 14, a circularly shaped heater may also be provided with openings 8. In the circular heater configuration, openings 8 allow the free passage of the tobacco flavored aerosol through the body of the smoking article in addition to providing thermal isolation between the heating elements 2.

Figure 15:
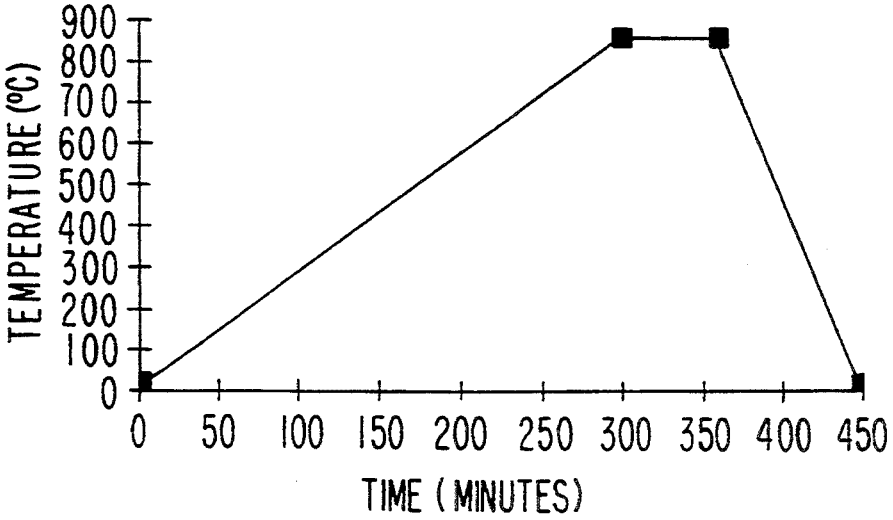
FIG. 15 is a plot of an illustrative furnace temperature cycle for firing the heaters in accordance with the invention.

Slots may be formed in green tape substrates by cutting with a blade prior to sintering. After cutting the slots in green tape, the tape may be sintered in a belt furnace that provides a temperature profile such as shown in FIG. 15. Slots may be formed in fired ceramic sheet substrates by using a $CO_2$ laser.

The heater should operate with low voltage batteries and generate heat through resistive heating to a maximum temperature in the range of 400° to 650° C. within a span of 2 seconds. The power needed to raise the temperature of the heater to its peak should be in the range of 10 to 20 watts. The power requirements of the heater determine the number of heating elements that a fully charged set of batteries set can energize. In a preferred embodiment, the batteries supply approximately 10 watts operating at 5 volts. Therefore, the desired resistance of a heater operating under the power constraint set by the batteries can be determined as follows:

$$R = \frac{E^2}{P}$$

Where
$R$ = resistance (in ohms)
$E$ = voltage (in volts)
$P$ = power (in watts)

$$R = \frac{25}{10} = 2.5\Omega$$

(where $E = 5$ V and $P = 10$ W)

From the above equations it can be seen that a 30% reduction in voltage reduces the power that a 2.5 Ω resistance draws by 50% to 5 W. For a resistance of 1.2 Ω, a voltage of 3.46 V suffices to produce the desired power of 10 W. The example above demonstrates that the electrical resistance of resistive heating elements 2 must not change significantly during heating.

Conventional resistive heater materials such as graphite, Ni—Cr alloys, metallic strips, $MoSi_2$, $ZrO_2$, and lanthanum chromate are generally not suitable because their low electrical resistivities may require excessive power to reach a temperature of 600° C. Acceptable heater materials include metallic or organometallic inks. A typical resistive ink comprises 10–30% Ag, 30–60% Pd, and 10–30% compounds of Al, B, Ca, Mg, Zn, Ba, $SiO_2$, and $TiO_2$. A typical conductive ink comprises greater than 60% Ag, 0.1–1% Pt and compounds of Al, B, Bi, Ca, Mg, Zn, Cu, Na, $SiO_2$, Pb and Ru. A preferred embodiment uses 7125D ink available from DuPont Electronics, Wilmington, Del. Other acceptable inks are available from Electro-Scientific Industries, Mount Laurel, N.J.

Resistive heating elements 2 generally have a thickness in the range of 0.2 mil (5 μm) to 5 mil (125 μm), widths in the range of 1.0 mm to 2.0 mm, and lengths in the range of 10 mm to 16 mm. In a preferred embodiment, shown in FIG. 1, resistive heating elements 2 are 1–4 mils (25–100 μm) thick, 1.3 mm wide and about 13 mm long, and are separated by slots approximately 0.5 mm wide.

Figure 2:
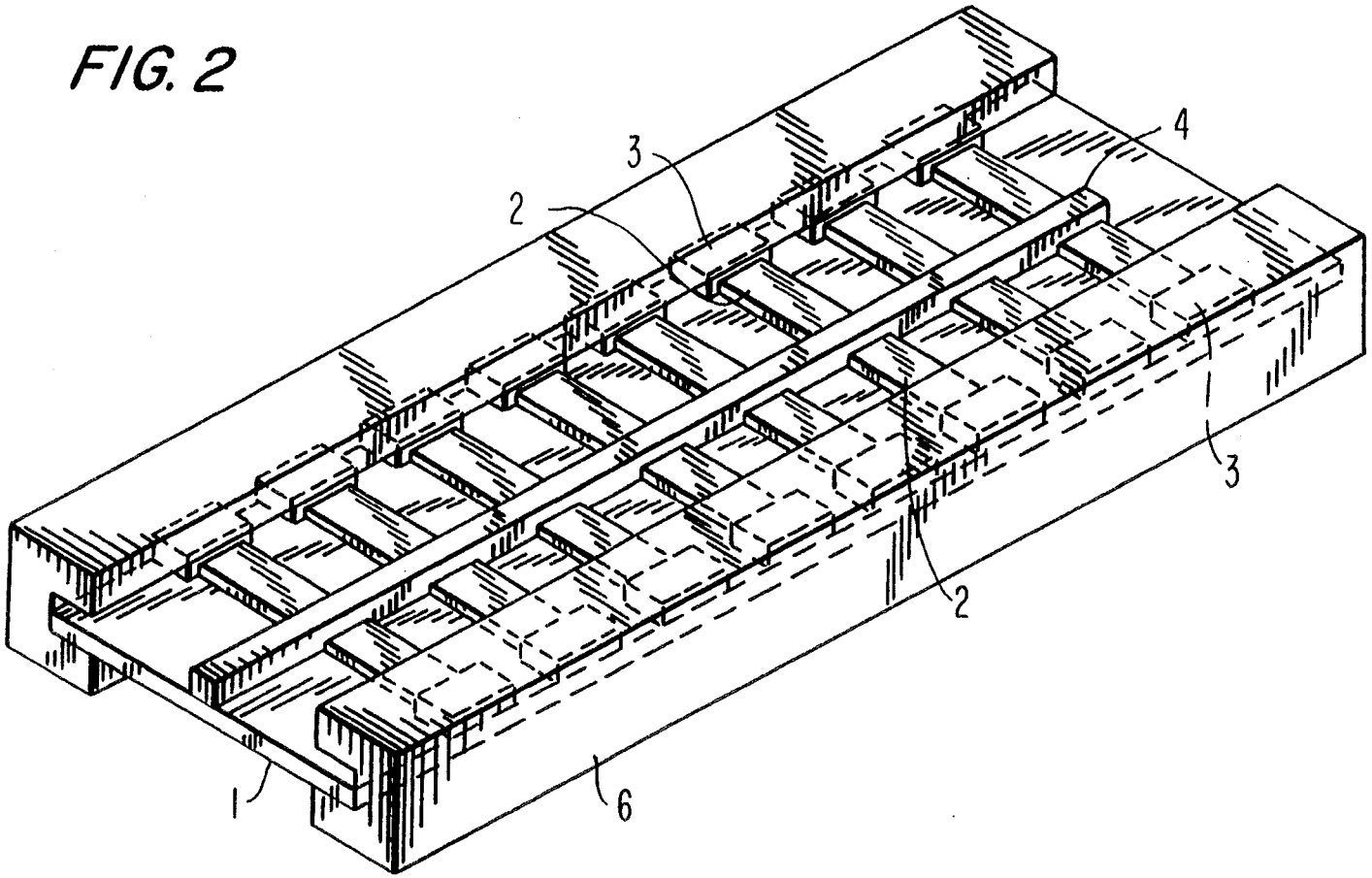
FIG. 2 is a view of the heater of FIG. 1 mounted in a socket.
Figure 3:
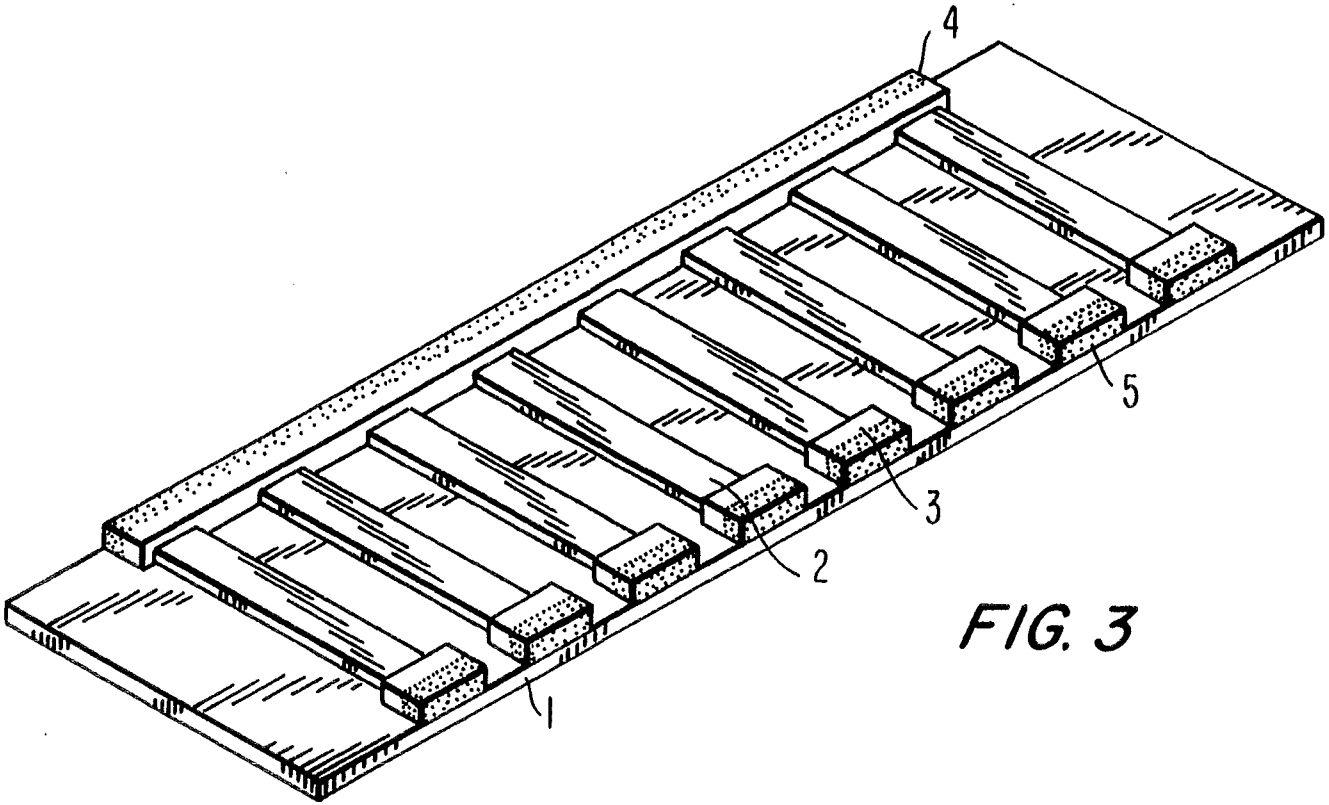
FIG. 3 is a perspective view of another illustrative embodiment of a heater constructed in accordance with the invention.
Figure 4:
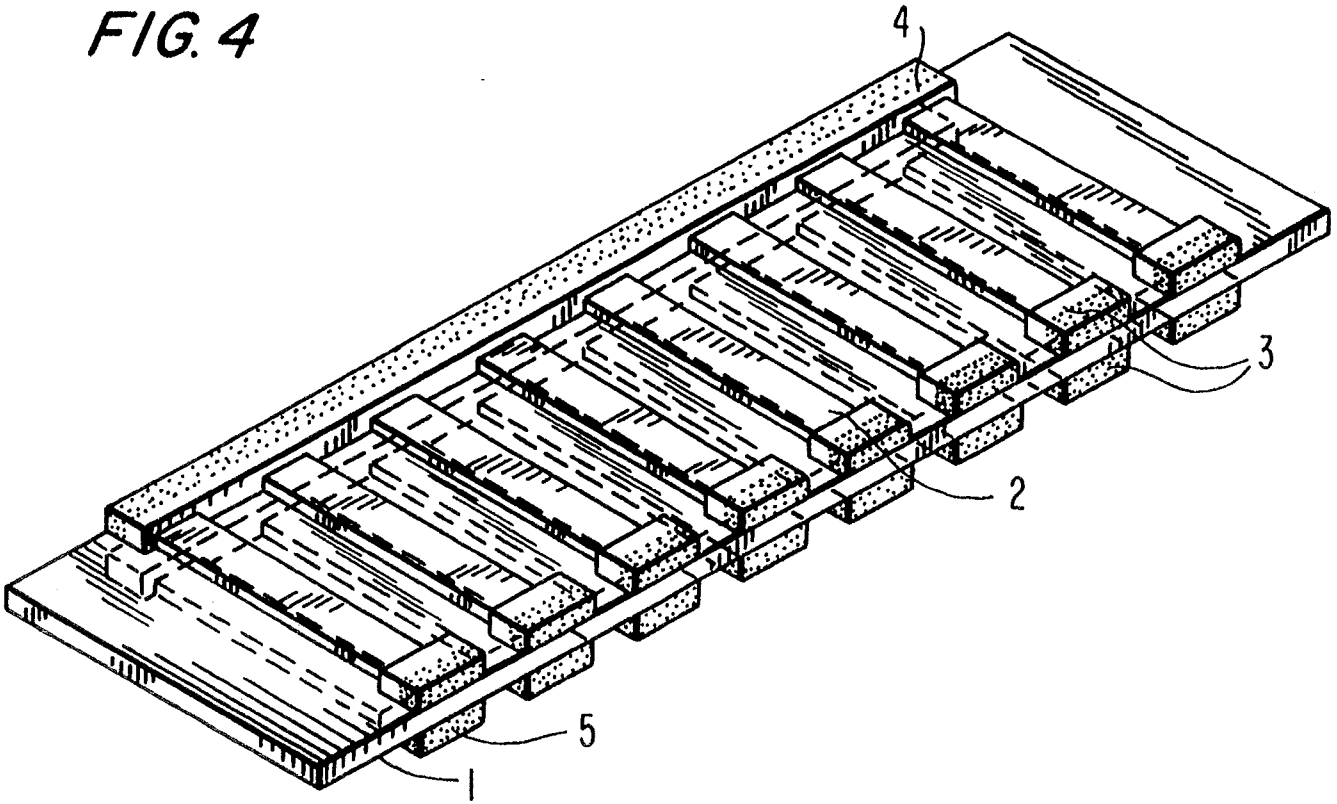
FIG. 4 is a perspective view of an illustrative embodiment of a heater constructed in accordance with the invention that has heating elements on both surface of the substrate.
Figure 5:
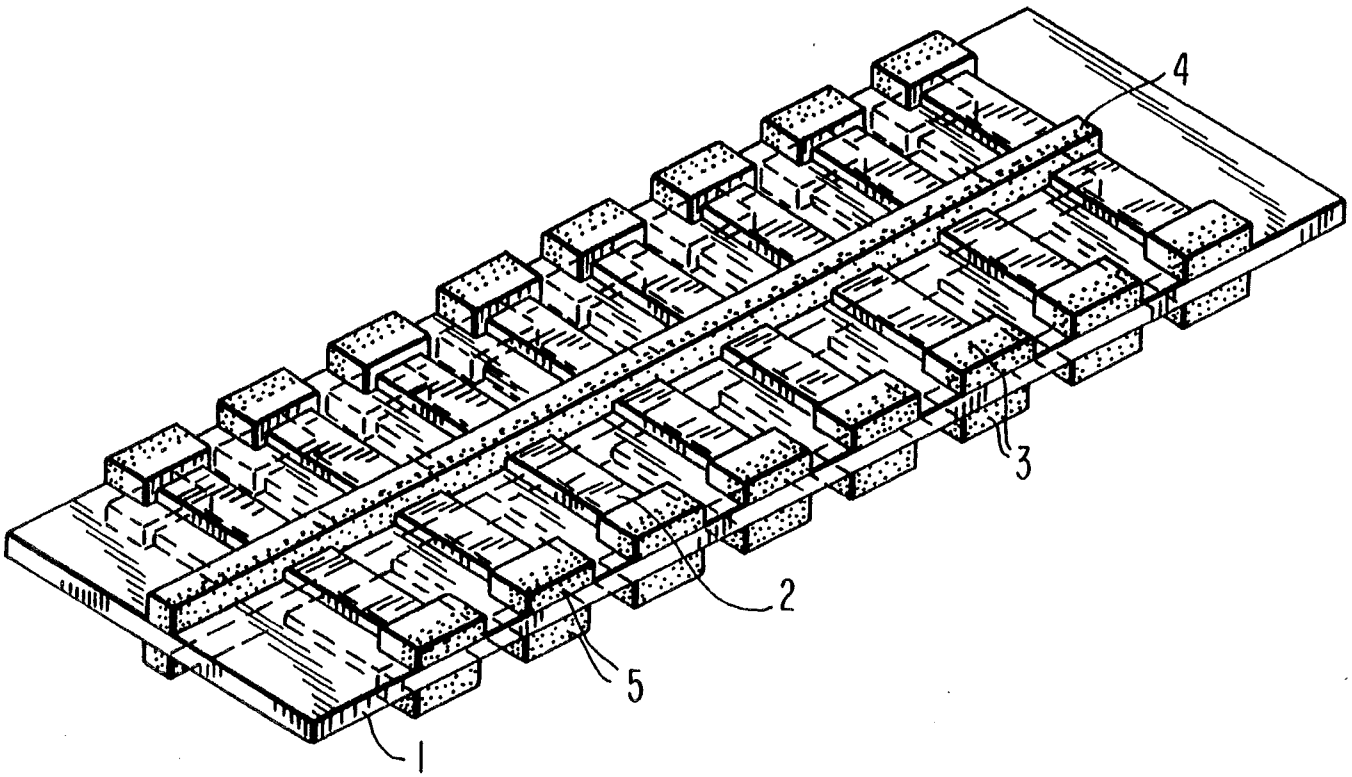
FIG. 5 is a perspective view of an illustrative embodiment of a heater constructed in accordance with the invention that is similar to the heater in FIG. 1, but with heating elements on both substrate surfaces.
Figure 6:
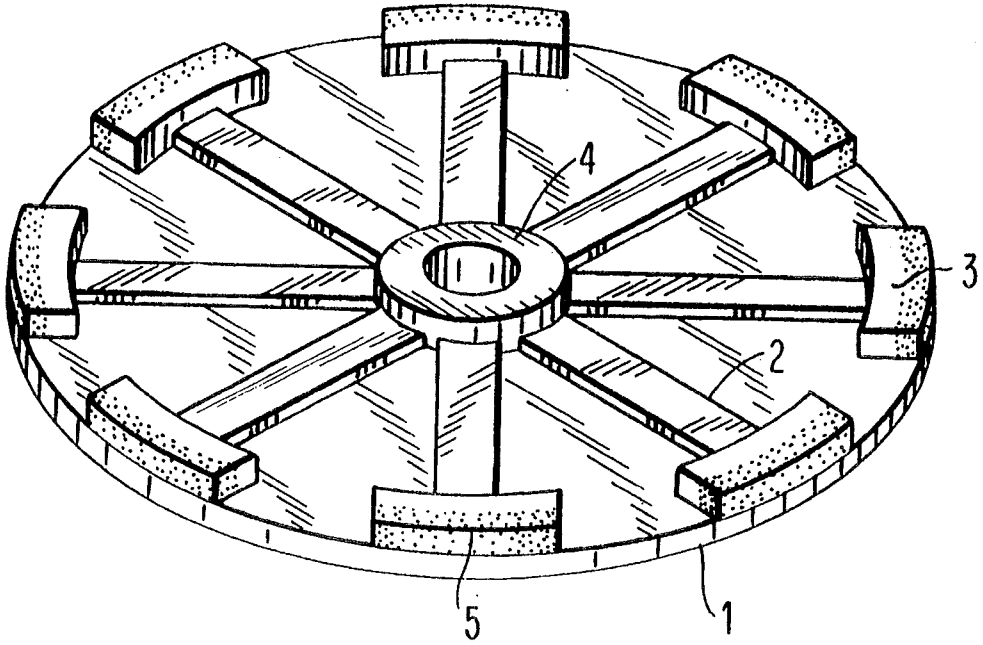
FIG. 6 is a perspective view of an illustrative embodiment of a heater constructed in accordance with the invention that uses a circular layout for the heating elements.
Figure 7:
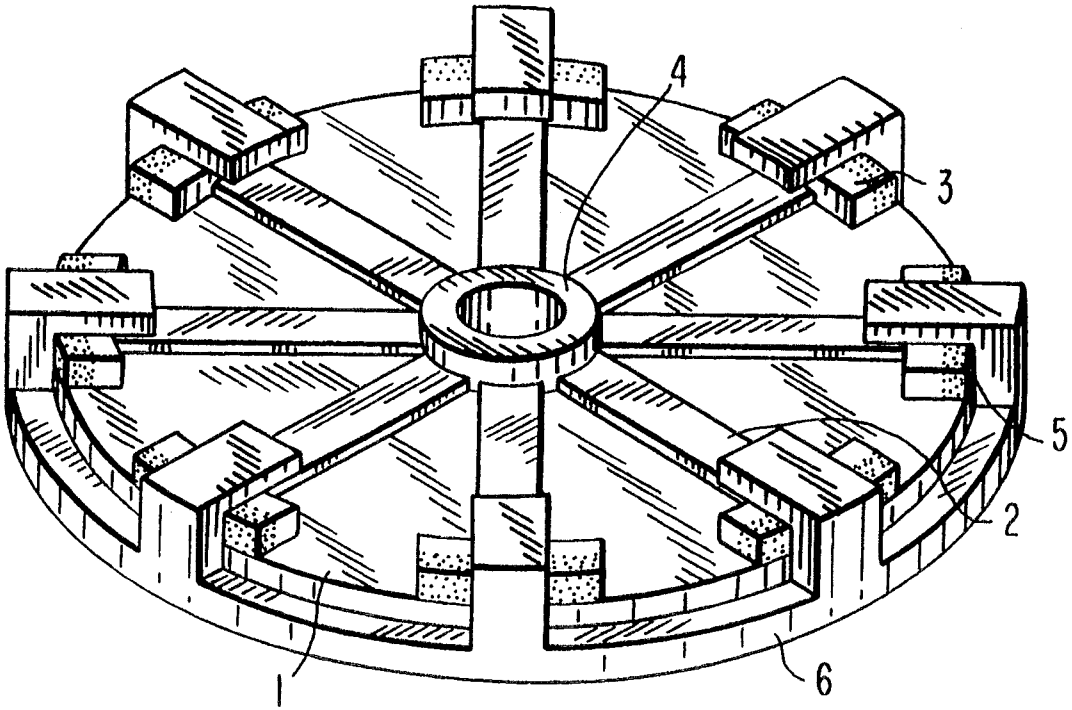
FIG. 7 is a view of the heater of FIG. 6 mounted in a socket.
Figure 8:
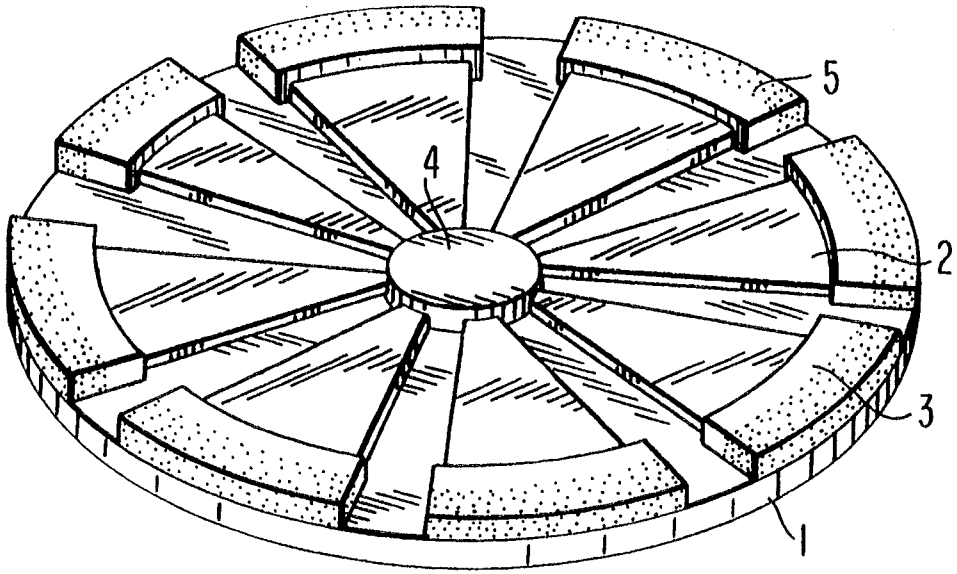
FIG. 8 is a perspective view of another illustrative embodiment of a circular-layout heater constructed in accordance with the invention.
Figure 9:
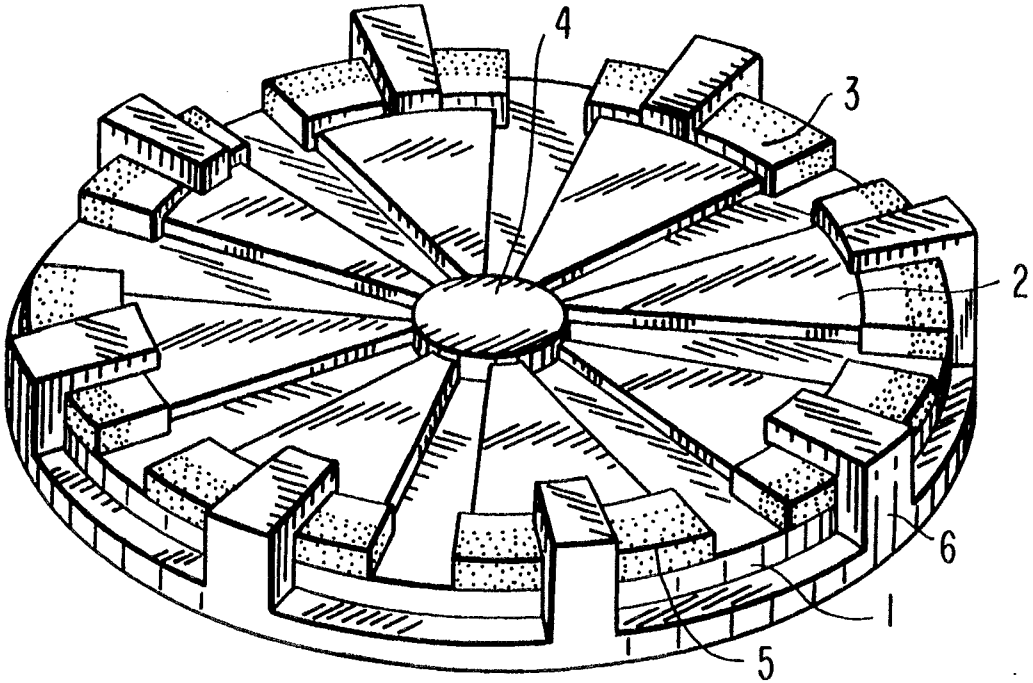
FIG. 9 is a view showing the heater of FIG. 8 mounted in a socket.
Figure 10:
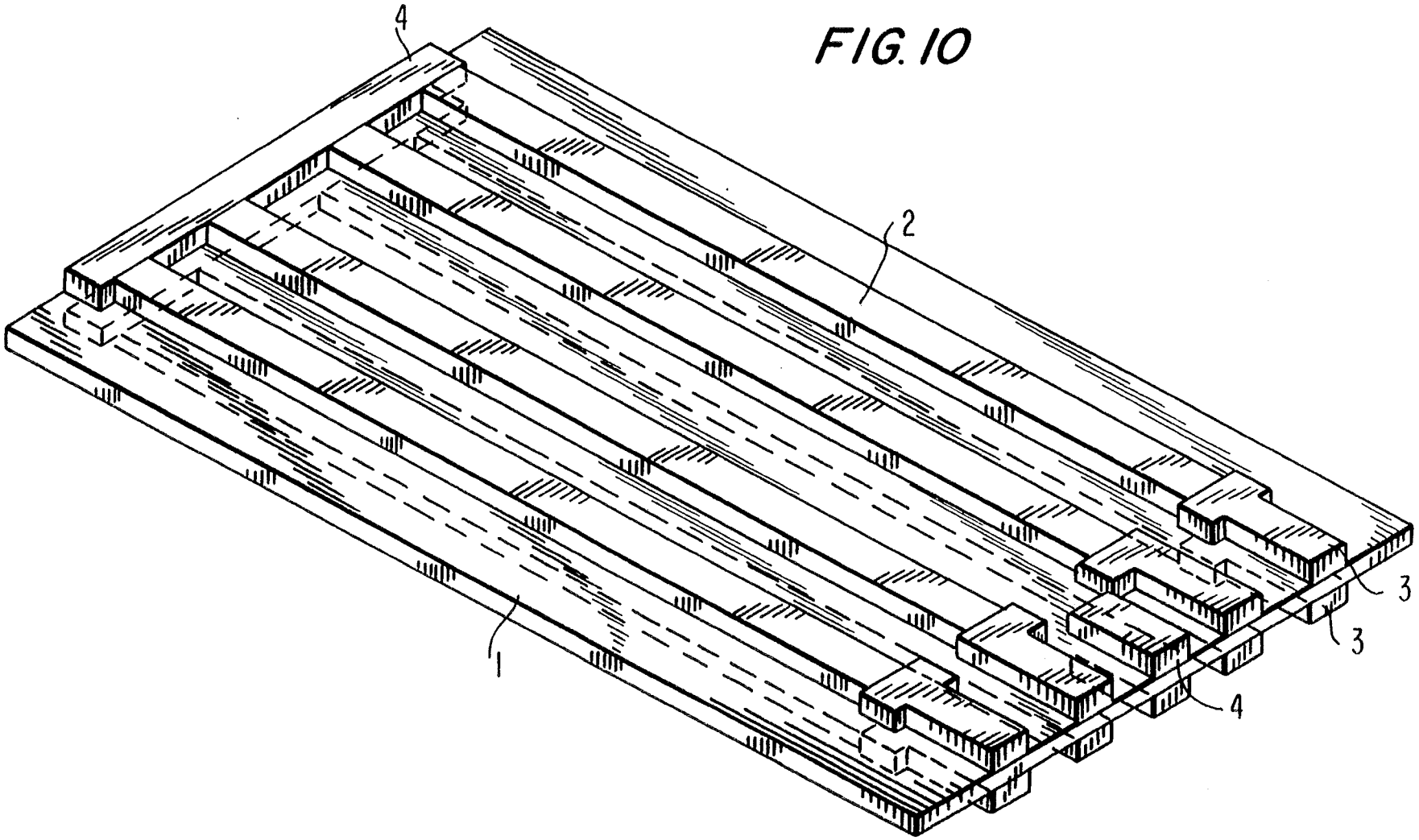
FIG. 10 is a perspective view of an additional illustrative embodiment of a heater constructed in accordance with the invention that has the heating elements arrayed parallel to the longer axis of a rectangular substrate.

The illustrative embodiments shown in FIGS. 1–14 have various advantages which may be particularly useful for specific applications. For instance, as shown in FIG. 5, the heater may be constructed so that both surfaces of the substrate are used, which allows a larger number of heating elements to be provided. As shown in FIG. 2, a smoking article may contain socket 6 for making the necessary electrical connections for use of a heater, although other techniques may also be used to make the necessary lead connections, such as conventional wire bonding.

One skilled in the art will appreciate that the resistive and conductive layers can be applied to the substrate in several ways, including techniques such as sputtering, physical vapor deposition, chemical vapor deposition, thermal spraying, and DC magnetron sputtering. However, most require the use of fairly expensive instruments, and involve processing the material in a vacuum. A preferred technique for high-speed production of heaters is screen-printing, which allows resistive and conductive materials to be screen-printed to desired thicknesses on green tape. The screen-printing process involves forcing a viscous thick film paste through a stencil screen to form a pattern on the substrate. The screen may be constructed of a stainless steel wire mesh or cloth, polyester or nylon filaments, or metallized polyester filaments. The mesh size may be tailored to the properties of the paste to be used. The resistive paste, which can consist of a combination of metals, non-metals, metal oxide and glass, is commercially available from DuPont Corporation of Wilmington, Del. in a variety of resistivity values. The sheet resistance of the paste increases with the loading concentrations of oxides and glass relative to the metals in the paste.

The thick film paste exhibits high viscosity, but its viscosity decreases sharply upon application of a shearing force, such as that applied to the paste when a rubber squeegee blade forces the paste through the screen. Thus, upon the application of force, the paste flows rapidly through the screen and prints a pattern on the substrate. Viscosity increases again when the force is withdrawn so that the paste retains its pattern.

The viscosity of the thick film paste may be adjusted by the addition of solvents or thinners such as pine oil, terpinol, butyl carbitol acetate or dibutylphthalate. Temporary binding materials such as polyvinyl acetate, ethyl cellulose or carboxy methyl cellulose (CMC) may be used to increase the cohesion of the paste during screen printing and sintering. A permanent binder, such as glass, fuses the printed material to the substrate and remains after sintering.

After printing, the paste is allowed to settle for approximately 10 minutes. The paste may then be dried in a 120°–150° C. oven for about 10–15 minutes before firing or may be dried during the firing process. The paste is typically fired using the same temperature profile that is used for the ceramic firing stage, shown in FIG. 15. In this step temporary organic binders are removed from the films by decomposition and oxidation, when the temperature is generally at 200°–500° C. At temperatures from 500°–700° C., the permanent binder within the resistive (or conductive) thick-film paste, which is glass frit in a preferred embodiment, melts and wets the surface of the substrate and the particles within the paste. During the sintering stage, the temperature is raised to 850° C., which causes the particles to become interlocked with the glass frit and the substrate. Although adequate results may be achieved by printing the second layer after drying the first layer, the most consistent results are achieved by performing the reprinting step after firing the first resistive layer.

The conductive elements, including the lead terminals for energizing the heaters, are screen printed next. The thickness of the conductive layer is generally in the range of 0.2 mils (5 μm) to 5 mils (125 μm). The thick film paste used to print conductive elements may incorporate silver, gold, platinum, palladium, copper, tungsten or combinations of these metals, together with solvents and binders.

At this point, the printed tape may be cut, for instance by a laser, into individual heaters each having a plurality of resistive heating elements 2. This cutting step may also be performed after sintering the conductive paste. The heater is placed on a support, preferably graphite or another high temperature insulator that can withstand a subsequent heating step, where a second cutting operation further trims the heater to its final size, which is preferably less than the 8 mm diameter of conventional smoking articles. The trimming operation can be carried out by a laser or by a punch.

After trimming, the conductive layer may be fired using the temperature profile of FIG. 15. The conductive paste reacts similarly to the resistive paste during firing, although the final resistance is much lower. The firing step also forms good ohmic contacts between the resistive and conductive elements.

Although in the heater fabrication process illustrated above, the ceramic, resistive paste, and conductive paste were fired in three separate firing stages, it is also possible, in accordance with the invention, to easily modify the process. For instance, the conductive paste could be fired before the resistive paste, or the resistive and conductive pastes could be fired simultaneously.

Figure 16:
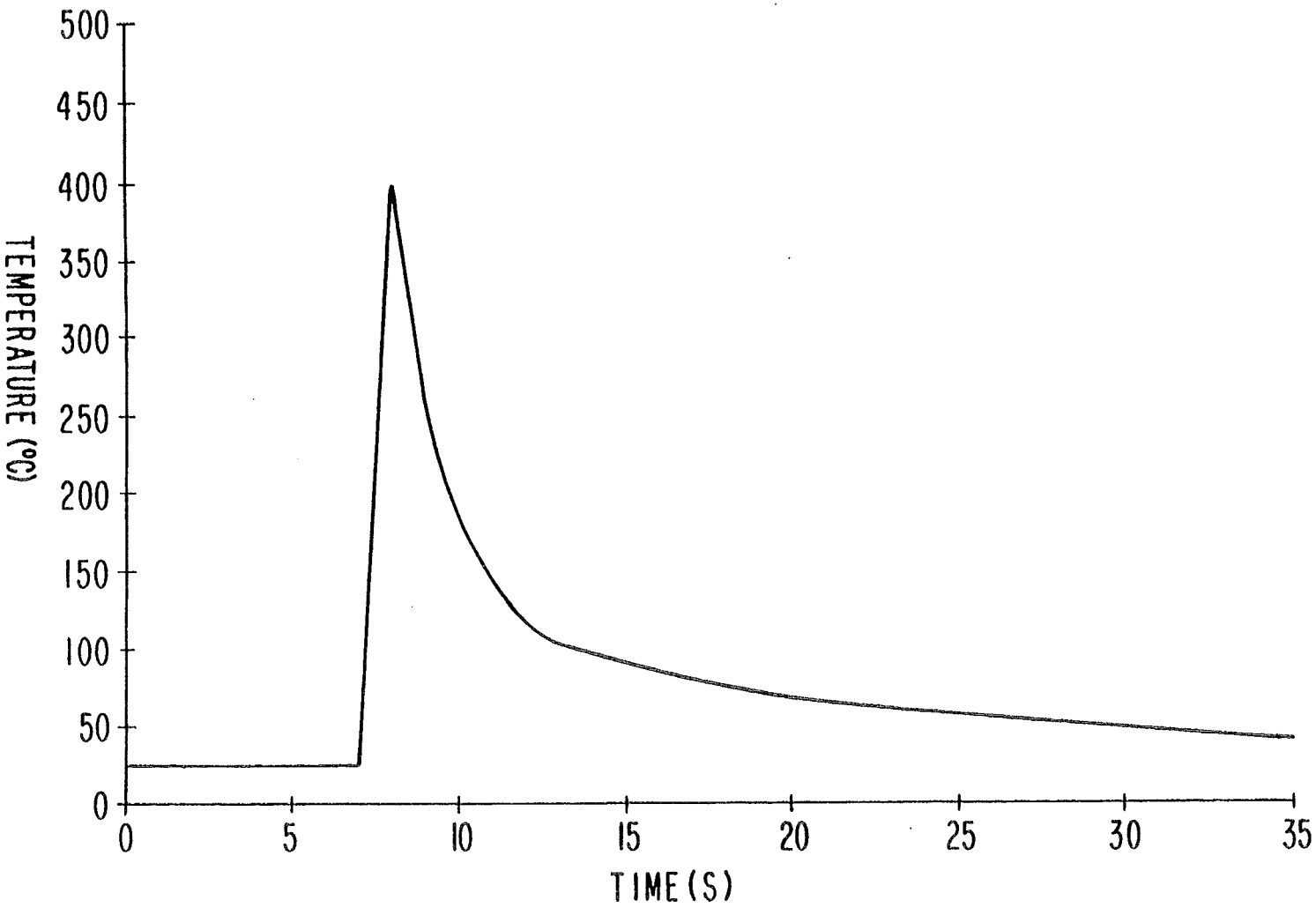
FIG. 16 is a plot showing the temperature attained by an illustrative heater versus time according to the invention; the heater was powered from printed heating elements that were formed on a solid fired ceramic substrate from Kyocera Corporation.
Figure 17:
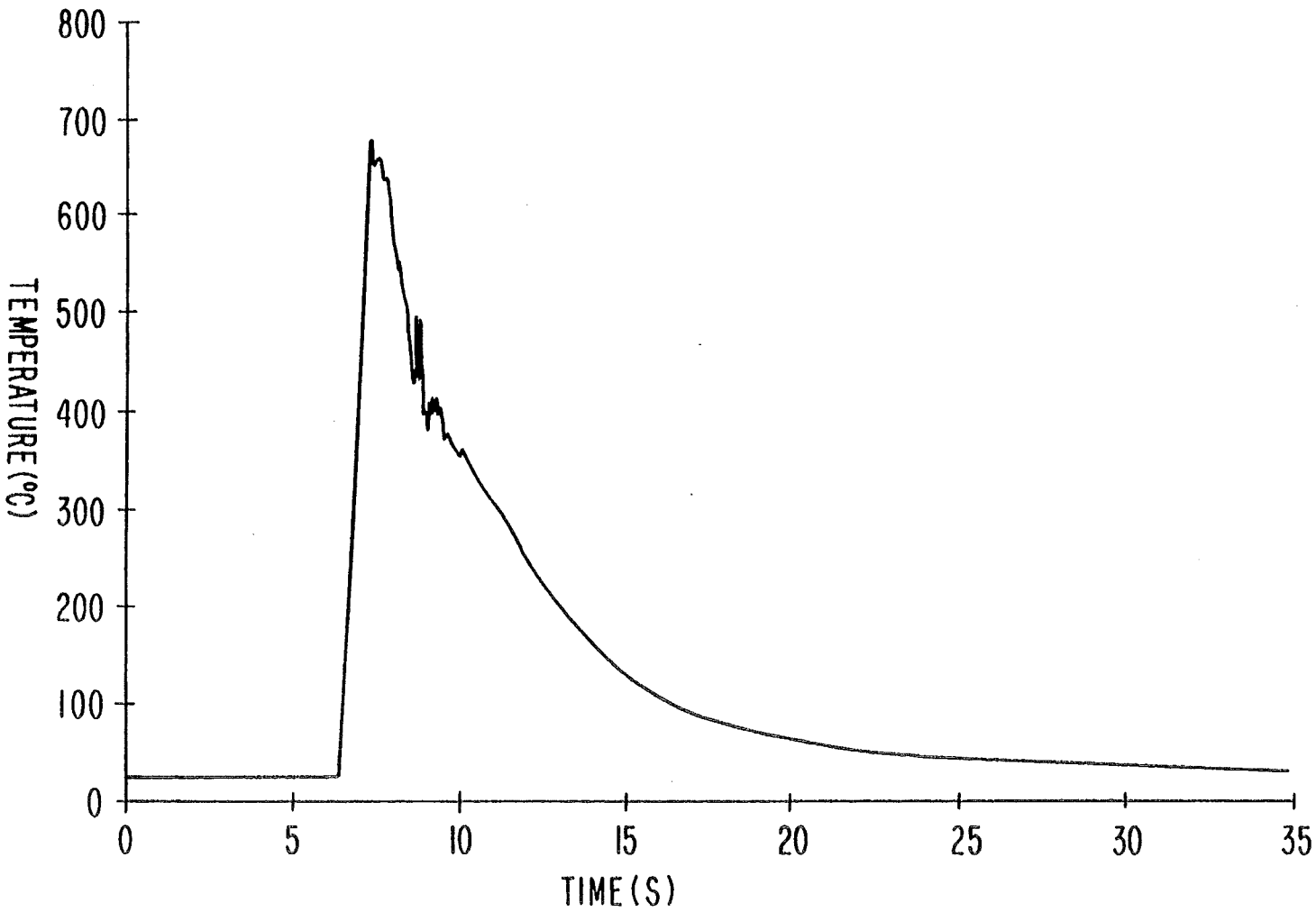
FIG. 17 is a plot showing the temperature attained versus time by an illustrative heater according to the invention; the heater was formed from printed heating elements that were formed on a fired ceramic substrate having slots between the elements from Kyocera Corporation.
Figure 18:
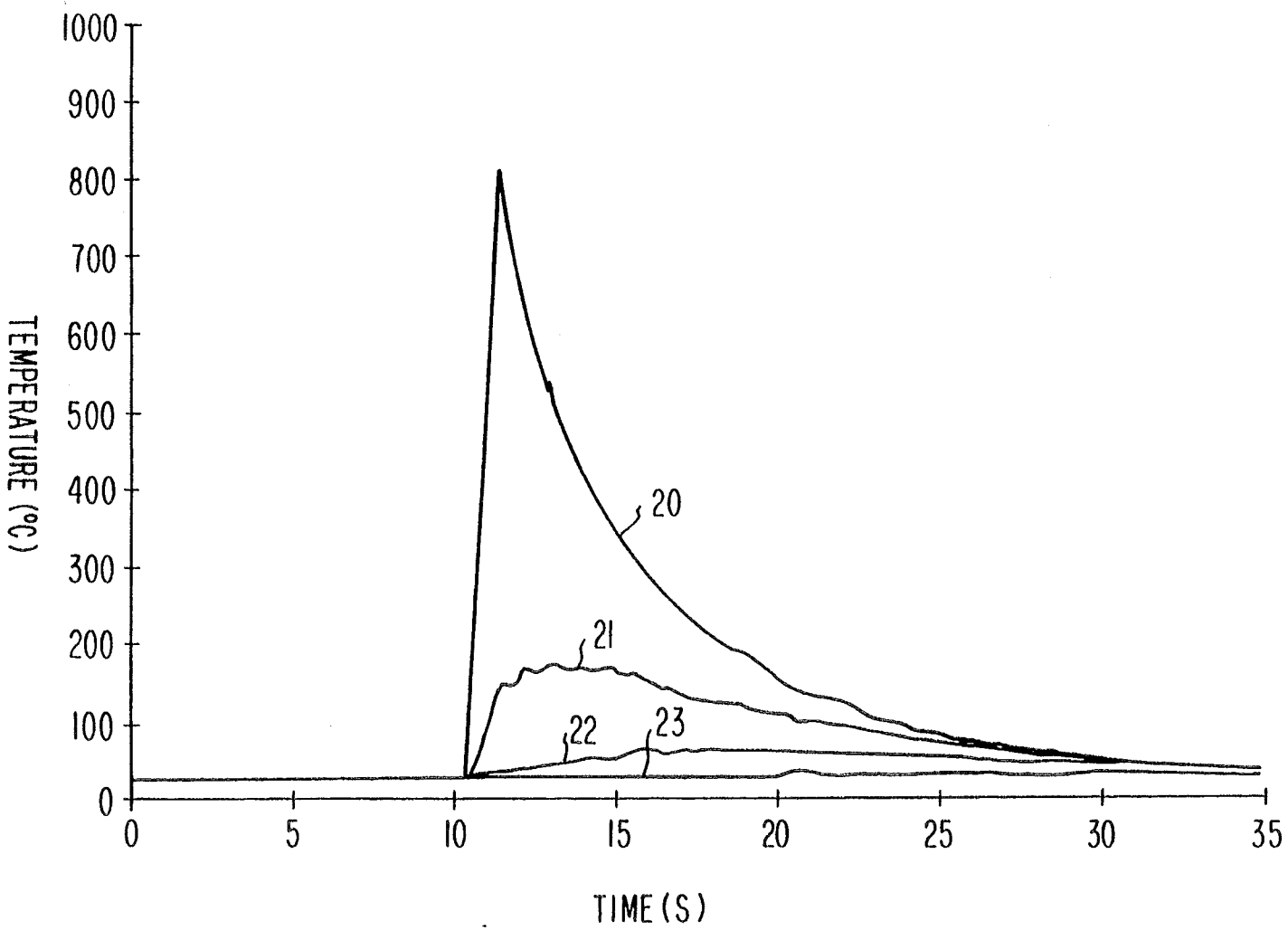
FIG. 18 is a plot showing the temperature attained versus time for an illustrative heating element according to the invention and the resulting rise in temperature in adjacent heating elements; the printed ceramic heating elements were formed on a ceramic having slots between the elements from DuPont Corporation.

The present invention may be more readily understood by reference to FIGS. 16–18, which detail the measured performance of heaters constructed in accordance with the invention. For instance, FIG. 16 shows the temperature attained by a heating element versus time as a result of applying a 5.0 V potential for 1.0 s across a heating element heaving a 1.21 Ω resistance. The heater temperature, which was measured by a thermocouple, rises to a maximum of approximately 400° C. After the potential is removed, the temperature decays.

FIG. 17 shows the effect of creating slots in the substrate between heating elements. The 1.25 Ω resistance of the heater used for the measurements of FIG. 17 is essentially the same as the resistance of the heater used for the measurements of FIG. 16. However, the greater thermal isolation that results from providing slots in the substrate between heating elements causes the temperature of the heater to rise to an approximately 700° C. maximum. Thus, by reducing thermal diffusion away from a heated resistive heating element, the temperature rise is produced more efficiently. Because the heater provides a temperature that is sufficiently high to create a tobacco aerosol for significantly longer than the non-slotted heater, even when drawing the same amount of battery power, battery life can be greatly extended by using slots.

Referring to FIGS. 12 and 18, when current is applied to heating element 10, temperature response 20 is produced. Due to thermal diffusion, the temperature of adjacent heater 11 is also raised (see thermal response 21). Thermal responses 22 and 23 show the effect of heat diffusing to heating element 12 and heating element 13. Although adjacent heating elements are not entirely thermally isolated from each other, they are isolated enough that the tobacco flavor-generating medium of adjacent elements will not be affected inadvertently when one of the heating elements is powered.

One skilled in the art will appreciate that the present invention can be practiced by other than the described embodiments, which are presented for purposes of illustration and not of limitation, and the present invention is limited only by the claims which follow.

What is claimed is:

1. In an electrically powered smoking article, a resistive heater adapted to heat tobacco sufficiently to release an aerosol, said heater comprising:

a ceramic substrate;

an electrically resistive film disposed along a surface of said ceramic substrate, said resistive film having a composition and dimensions providing a predetermined resistivity; and electrical contacts at first and second locations along said resistive film, said contacts adapted to connect said electrically resistive film with a battery, said predetermined resistivity and said battery arranged to produce a temperature at said electrically resistive film within one second in the range of about 300° to 900° C. upon application of electrical power from said battery to said electrically resistive film; and first and second conductive coatings comprising an inert conductive metal of sufficient thickness to reduce electrical resistance at said electrical contacts.

2. The heater of claim 1, wherein the ceramic substrate material is selected from the group consisting of alumina, zirconia and mullite.

3. The heater of claim 2 wherein the resistive film is formed from a resistive ink comprising between 10% to 30% silver and from 30% to 60% palladium.

4. The resistive heater of claim 1, wherein said ceramic substrate is constructed from alumina green tape.

5. The heater of claim 1 wherein a plurality of resistive films are disposed on said substrate, each of which is provided with said electrical contacts such that each resistive film is switchably and independently connectable to said battery.

6. The heater of claim 5 wherein the electrical contacts include a conductor bus bar electrically connected to the resistive films at said first location.

7. The heater of claim 6, wherein said ceramic substrate has a disc shape, said resistive films extending radially along said surface of said ceramic substrate, said bus bar having an annular form at a central location on said disc shape.

8. The heater of claim 6, wherein said substrate surface is rectangular and said bus bar extends along said surface of said ceramic substrate parallel to an edge of said ceramic substrate.

9. The heater of claim 5 wherein the thickness of the ceramic substrate is in the range of about 25 μm to 700 μm.

10. The heater of claim 5 wherein the resistive films have a thickness in the range of about 25 μm to 125 μm.

11. The heater of claim 5 wherein the ceramic substrate is formed from a material selected from the group consisting of alumina, zirconia, magnesia, yttria, cordierite, and mullite.

12. The heater of claim 5 wherein the ceramic substrate has portions defining slots, the slots being disposed between the resistive films for thermally isolating each resistive film from adjacent resistive films for reducing thermal diffusion away from a heated resistive film.

13. The heater of claim 12 further comprising a spacer located between first and second layers of said ceramic substrate, each of said layers being provided with said resistive films, said electrical contacts and said conductive coatings.

14. The heater of claim 12, wherein said ceramic substrate has a disc shape, said resistive films extending radially along said surface of said ceramic substrate, said bus bar having an annular form at a central location on said disc shape.

15. The heater of claim 12, wherein said substrate surface is rectangular and said bus bar extends along said surface of said ceramic substrate parallel to an edge of said ceramic substrate.

16. The heater of claim 1, wherein said electrical contacts are formed from a conductive thick film paste having components selected from the group consisting of silver, gold, platinum, palladium, copper and tungsten.

* * * * *